US007313830B2

(12) United States Patent
Desjardins et al.

(10) Patent No.: US 7,313,830 B2
(45) Date of Patent: Jan. 1, 2008

(54) ATHLETIC GLOVE WITH THUMB PROTECTOR

(75) Inventors: Mathieu Desjardins, Montreal (CA); Alain Castonguay, Blainville (CA)

(73) Assignee: Sport Maska Inc., Montreal (CA)

( * ) Notice: Subject to any disclaimer, the term of this patent is extended or adjusted under 35 U.S.C. 154(b) by 180 days.

(21) Appl. No.: 11/357,960

(22) Filed: Feb. 22, 2006

(65) Prior Publication Data

US 2007/0204380 A1 Sep. 6, 2007

(51) Int. Cl.
*A41D 19/00* (2006.01)

(52) U.S. Cl. ..... 2/161.1; 2/16

(58) Field of Classification Search ..... 2/16, 2/20, 161.1, 161.6, 163, 21, 161.2–161.5
See application file for complete search history.

(56) References Cited

U.S. PATENT DOCUMENTS

| | | | | |
|---|---|---|---|---|
| 4,677,698 | A | 7/1987 | Angas | |
| 5,450,625 | A | 9/1995 | Hu | |
| 5,488,739 | A | 2/1996 | Cardinal | |
| 5,511,243 | A | 4/1996 | Hall et al. | |
| 5,511,244 | A | 4/1996 | Shikatani | |
| 5,745,916 | A | 5/1998 | Linner | |
| 5,781,929 | A | 7/1998 | Shikatani | |
| 5,884,329 | A | 3/1999 | Goldsmith et al. | |
| 5,983,396 | A | 11/1999 | Morrow et al. | |
| 5,996,117 | A | 12/1999 | Goldsmith et al. | |
| 6,085,354 | A | 7/2000 | Wilder et al. | |
| 6,233,744 | B1 | 5/2001 | McDuff | |
| 6,374,408 | B1 | 4/2002 | Tomlinson et al. | |
| 6,543,057 | B2 | 4/2003 | Béland et al. | |
| 6,732,376 | B2 | 5/2004 | Hoffman | |
| 6,813,781 | B2 | 11/2004 | Wilder et al. | |
| 6,836,905 | B2 | 1/2005 | Sande | |
| 6,874,168 | B1 | 4/2005 | Kuhuski | |
| 7,275,268 | B2 * | 10/2007 | Gait | 2/161.1 |
| 2002/0013961 | A1 | 2/2002 | Kleinert | |
| 2003/0106131 | A1 | 6/2003 | Tremblay | |
| 2004/0093656 | A1 | 5/2004 | Morrow et al. | |
| 2004/0181850 | A1 | 9/2004 | Beland | |
| 2004/0187190 | A1 | 9/2004 | Wilder et al. | |
| 2004/0250335 | A1 | 12/2004 | Jaeger et al. | |

* cited by examiner

*Primary Examiner*—Katherine Moran
(74) *Attorney, Agent, or Firm*—Ogilvy Renault LLP

(57) ABSTRACT

A hockey glove including a thumb portion comprising first and second protective portions disposed on a dorsal side of the thumb portion. The second portion includes a rigid shell and is disposed overtop of at least a proximal end of the first portion. The first and second protective portions are articulated relative to each other such that inward flexion of the first protective portion away from the second protective portion is permitted. A rigid projection, disposed on a dorsal side of the first protective portion, is received within an opening formed in the second protective portion when the first and second protective portions are aligned, such that proximal displacement of the first protective portion relative to the second protective portion is limited by the rigid projection.

20 Claims, 4 Drawing Sheets

ATHLETIC GLOVE WITH THUMB PROTECTOR

TECHNICAL FIELD

The present invention relates generally to wearable protective equipment, and more particularly to a protective athletic glove.

BACKGROUND OF THE INVENTION

Risk of injuries is always of concern for athletes, particularly for athletes competing in contact and/or physical sports in which protective clothing is worn to limit injuries, such as for example sporting activities including ice hockey, lacrosse, cricket, field hockey, motor cycle riding, and the like. Particularly for stick based sports such as ice hockey, field hockey, lacrosse and cricket, players wear protective gloves such as to limit potential damage to their hands and wrists which may be caused by impacts directed thereagainst by the puck, ball or other players sticks, as the case may be.

Such protective athletic gloves must offer protection to the wearer's hands and wrists, while nevertheless permitting the wearer good flexibility and range of motion. The fingers and thumbs are often vulnerable to impacts, and thus most protective gloves are heavily padded on their exterior while the interior surfaces (i.e. those surfaces on the palm side of the hand which typically contact the stick) are unpadded or have only limited padding. Further, as thumbs are particularly vulnerable, especially to hyperextension, the thumb portion of many protective athletic gloves include a rigid outer shell which is engaged to the glove so as to limit any undue rearward movement of the thumb which might cause hyperextension thereof. However, such rigid outer shells tend to limit flexibility and restrict freedom of movement of the thumb.

While articulated thumb portions in more recently developed protective athletic gloves have attempted to address the problem of providing good protection to impact and hyperextension of the thumb, while nevertheless permitting good flexibility and freedom of movement, improvement in this regard is nonetheless sought.

Therefore, there remains a need for a protective athletic glove capable of offering improved thumb protection.

SUMMARY OF THE INVENTION

It is thus an object of the present invention to provide an improved protective athletic glove.

It is another object of the present invention to provide an improved protective athletic glove having a articulated reinforced thumb portion.

Therefore, in accordance with one aspect of the present invention, there is provided a protective athletic glove, the glove having a thumb portion defining an inner palm side and an opposed outer side, the thumb portion comprising: a main thumb member including a sheath within which a wearer's thumb is received and having an inner side which defines said inner palm side of the thumb portion; a rigid outer protector disposed on said outer side of said thumb portion overtop a partial portion of said main thumb member, said main thumb member being articulated relative to said rigid outer protector such as to permit inward flexion of said main thumb member while preventing significant outward extension thereof relative to said rigid outer protector; and a rigid projection protruding from the outer side of said main thumb member, said rigid projection being received within a corresponding opening formed in said rigid outer protector when the main thumb member is fully outwardly extended relative to said rigid outer protector such that they are abutted along their length; whereby said rigid projection, when received within said opening, limits proximal displacement of said main thumb member relative to said rigid outer protector.

In accordance with another aspect of the present invention, there is provided a protective glove for a hand, the glove including a thumb receiving portion having a dorsal side and an inner palm side, the thumb receiving portion comprising: a rigid thumb shell covering a proximal end of the dorsal side of the thumb receiving portion such that a distal portion of the thumb receiving portion is exposed, the rigid thumb shell having a notch formed therein at a distal end thereof; and a rigid projection protruding from the dorsal side of said thumb receiving portion distally of said rigid thumb shell, said rigid projection being received within said notch of said rigid thumb shell when said thumb receiving portion is fully extended relative to said rigid thumb shell such that proximal displacement of said thumb receiving portion relative to said rigid thumb shell is limited.

There is also provided, in accordance with another aspect of the present invention, a hockey glove for protecting at least a wearer's hand having a dorsal side, a palm side, four fingers and one thumb having itself a dorsal side, an inner palm side, a middle phalanx, a distal phalanx and an articulation between said middle and distal phalanxes, the hockey glove comprising: a rigid thumb shell disposed overtop of a dorsal side of a thumb receiving portion within which the thumb of the wearer's hand is received, the rigid thumb shell covering a proximal portion of said dorsal side of the thumb receiving portion such that a distal end thereof is dorsally exposed, the thumb receiving portion being articulated with said rigid thumb shell such that inward flexion of said thumb receiving portion away from said rigid thumb shell is permitted while significant outward extension of said thumb receiving portion relative to said rigid thumb shell is prevented; and a rigid projection protruding from the dorsal side of said thumb receiving portion distally of said rigid thumb shell, said rigid projection being received within a notch formed in a distal end of said rigid thumb shell when said thumb receiving portion is fully extended relative to said rigid thumb shell, such that proximal displacement of said thumb receiving portion relative to said rigid thumb shell is limited by said rigid projection.

There is further provided, in accordance with another aspect of the present invention, a hockey glove for protecting at least a wearer's hand, the hockey glove including a thumb portion having a dorsal side and an inner palm side and within which a thumb of the wearer's hand is received, the thumb portion comprising: first and second protective portions disposed on said dorsal side of the thumb portion, the second portion including a rigid shell and being disposed overtop of at least a proximal end of said first portion such that the second protective portion overlaps said first protective portion, said first and second protective portions being articulated relative to each other such that inward flexion of said first protective portion away from said second protective portion is permitted; and a rigid projection disposed on a dorsal side of said first protective portion, said rigid projection being received within an opening formed in said second protective portion when said first protective portion is aligned with and fully outwardly extended relative to said second protective portion, such that proximal displacement of said first protective portion relative to said second protective portion is limited by said rigid projection.

BRIEF DESCRIPTION OF THE DRAWINGS

Further features and advantages of the present invention will become apparent from the following detailed description, taken in combination with the appended drawings, in which.

DETAILED DESCRIPTION OF THE PREFERRED EMBODIMENT

Figure 1:
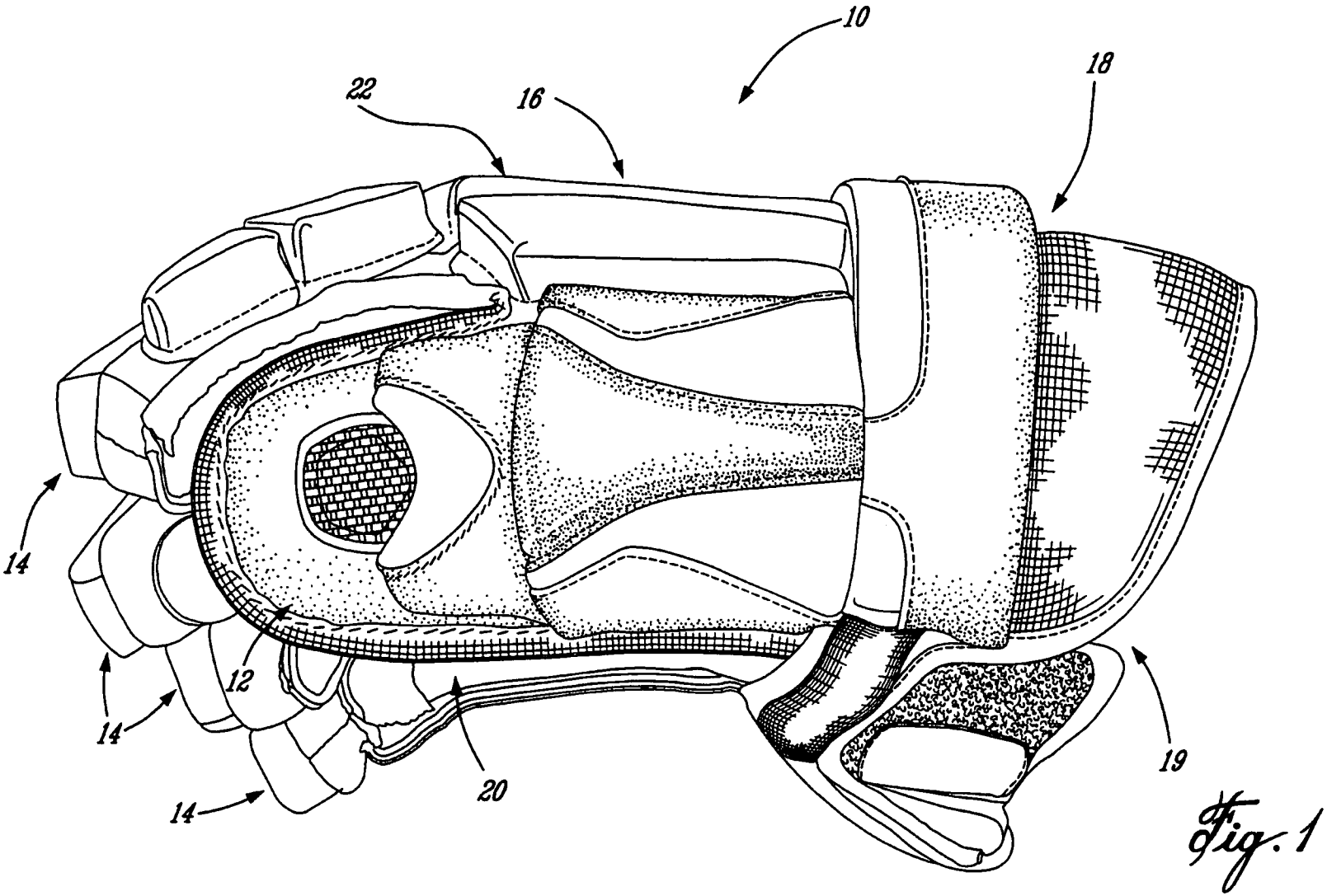
FIG. 1 is a perspective side view of the protective athletic glove in accordance with the present invention.

Referring to FIG. 1 a protective athletic glove 10, such as that which may be worn for contact stick sports such as hockey and lacrosse or for operating motorized vehicles such as motorcycles, snowmobiles and the like, generally comprises four finger portions 14 and a thumb portion 12 which extend from a main glove body 16 having a cuff 18 disposed proximate an open hand receiving end 19 of the glove. The main glove body 16 includes an inner palm side 20 and a padded outer dorsal side 22 generally covering the back side of the wearer's hand.

Although the protective athletic glove 10 as depicted and and described in further detail below is particularly intended for use as an ice hockey glove, it is to be understood that the protective athletic glove 10 of the present invention can be used for other types of athletic activities during which protection of the hands, and particularly the thumb, is desired.

Figure 2:
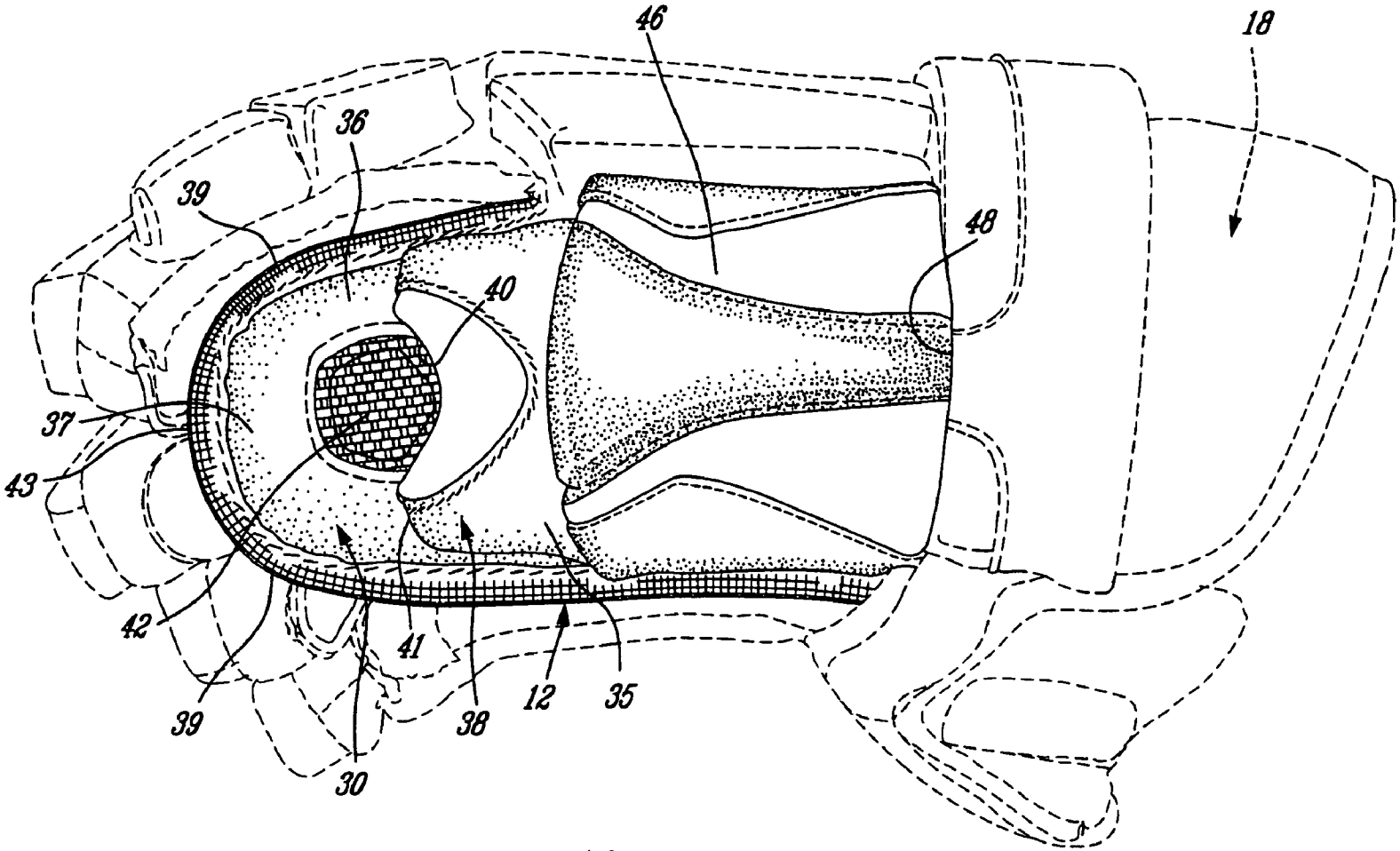
FIG. 2 is top view of the thumb portion of the hockey glove of FIG. 1.
Figure 3:
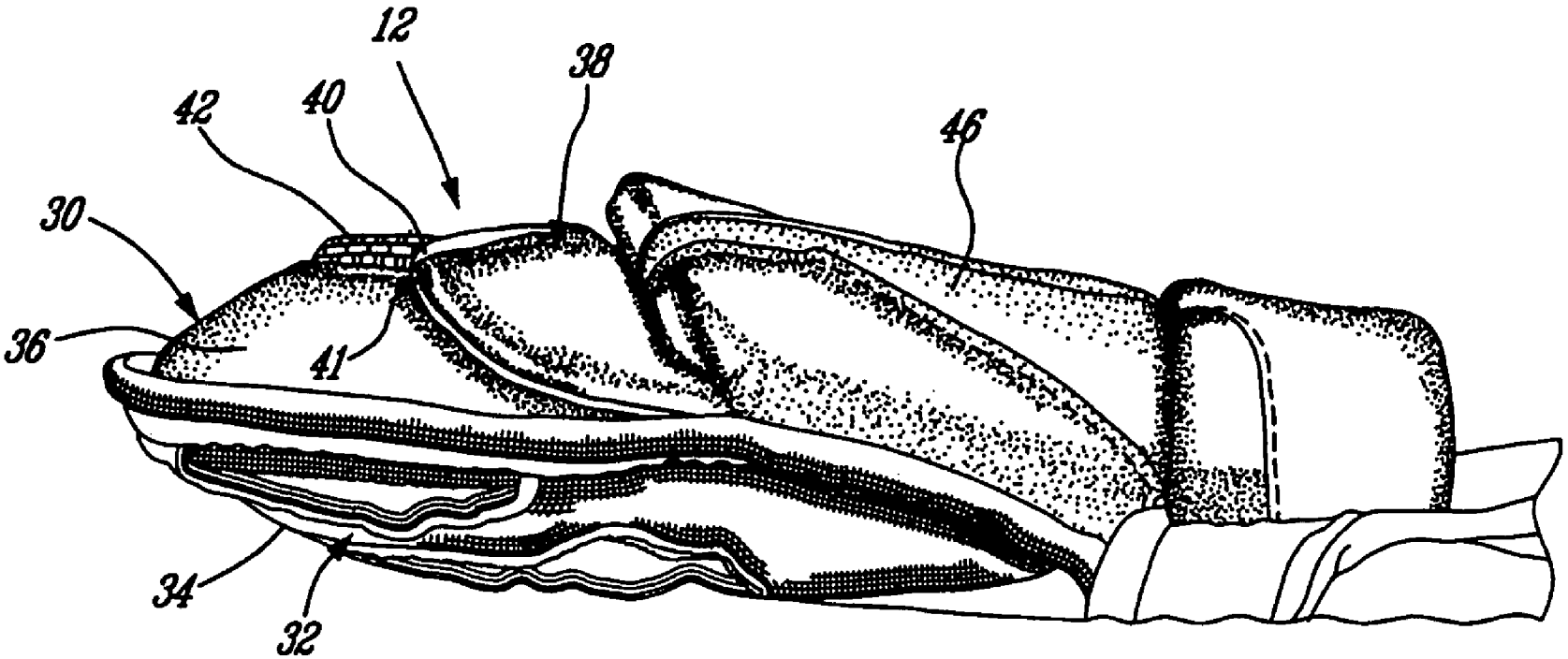
FIG. 3 is a side view of the thumb portion of the hockey glove of FIG. 1.
Figure 4:
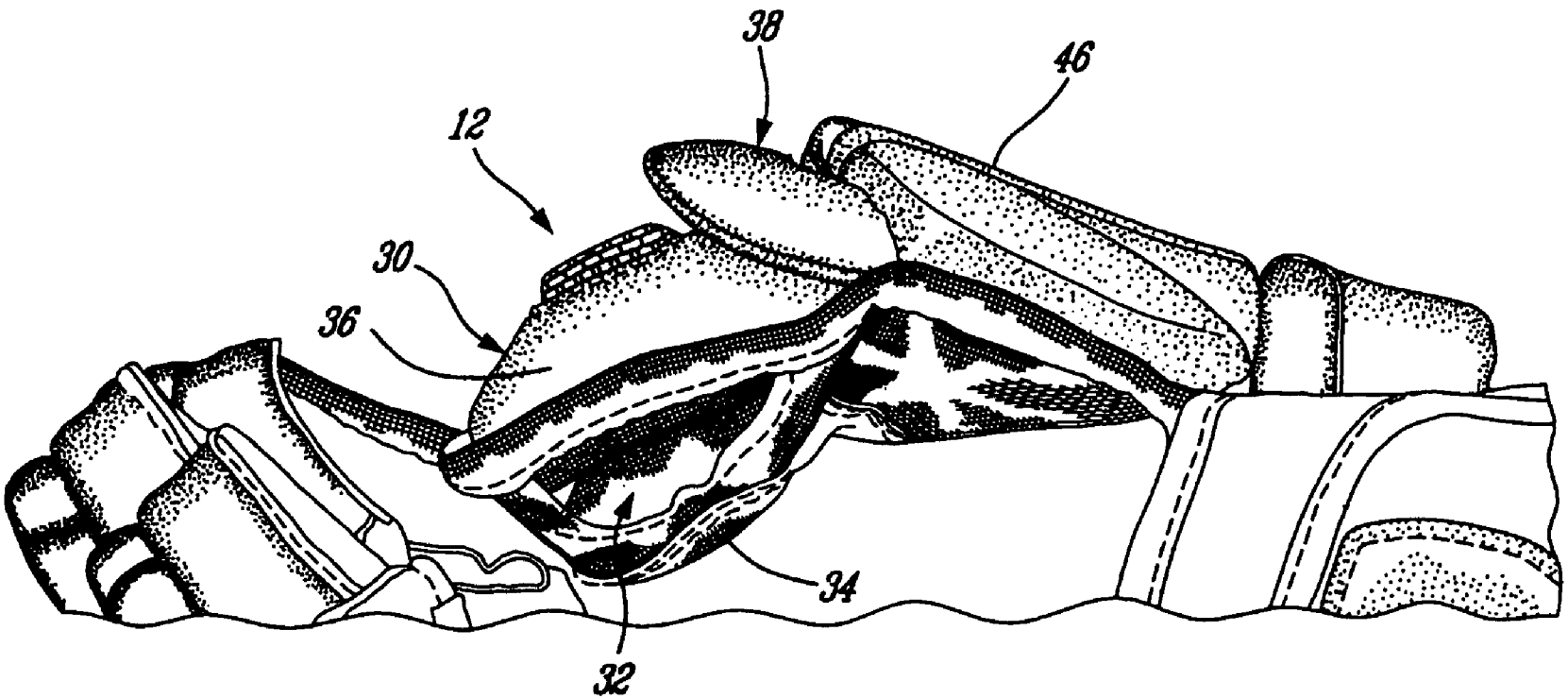
FIG. 4 is a perspective inner side view of the protective athletic glove of FIG. 1.

As seen in FIGS. 2 to 4, the thumb portion 12 of the protective athletic glove 10 includes a main thumb member 30 having a sheath 32 (best seen in FIG. 2) within which the wearer's thumb is received when wearing the glove. The sheath 32 is located on the inner or palm side 34 of the thumb portion 12 which is adapted to contact a stick or handlebar which is gripped by the wearer of the protective glove. A rigid outer protector or outer thumb shell 38 is disposed dorsally or overtop of at least a proximal end of the main thumb member 30. The main thumb member 30 is articulated relative to the rigid outer protective thumb shell 38 such that inward flexion of the main thumb member 30 is possible relative thereto. However the rigid thumb shell 38, which is engaged to the main body 16 of the protective glove 10, prevents any significant outward extension of the main thumb member 30 relative to the rigid thumb shell. Thus, the rigid thumb shell 38 protects at least a part of the main thumb member 30 from external impacts and also helps prevent hyperextension of the wearer's thumb by limiting outward extension of the main thumb member, within which the thumb is received, relative to the more rigid outer shell 38. In the embodiment depicted, the main thumb member 30 includes padding on the outer dorsal side 36 of the main thumb member 30 to protect the distal end 37 of the thumb from impacts.

As described above, the rigid outer thumb shell 38 extends only partially along the length of the main thumb member 30, particularly covering only a proximal end 35 of the main thumb member 30 such as to leave the distal end 37 thereof protruding beyond the distal edge 41 of the protective shell 38, such that the dorsal or outer surface 36 of the main thumb member's distal end 37 is exposed.

A rigid projection 42 protrudes from the outer dorsal side 36 of the main thumb member 30 and, in at least the embodiment shown, is disposed on the distal end 37 thereof. The rigid projection 42 may be an upstanding button, ridge or other rigid element. The rigid projection 42 is received within a correspondingly-shaped opening 40 defined in the distal edge 41 of the rigid outer thumb shell 38. The rigid projection 42 is received within the opening 40, which may be a notch or other suitable opening shaped and configured to at least partially correspond to the shape of the rigid projection 42, when the main thumb member 30 is fully extended relative to the rigid thumb shell 38 (i.e. such that it is located in a position as depicted in FIG. 3). When the main thumb member 30 is thus fully extended, the mating of the rigid projection 42 and the opening 40 formed in the rigid thumb shell 38 effectively retain the two articulated portions (i.e. the main thumb member 30 and the rigid shell 38) together to prevent or at least limit proximal displacement of the main thumb member 30 relative to the rigid thumb shell 38. This helps prevent injury to the wearer's thumb which might otherwise be caused by impacts on the distal tip of the thumb which attempt to jam the thumb inward toward the wearer's wrist. The engagement between the rigid projection 42 on the main thumb member 30 and the rigid dorsal thumb shell 38 also help prevent or at least limit significant outward extension of the main thumb member 30, and therefore also the user's thumb, in order to further reduce the likelihood of the wearer hyper extending his or her thumb when wearing the protective athletic glove 10.

In the embodiment depicted in FIGS. 1-4, the thumb portion 12 of the protective athletic glove 10 also includes an additional outer padded portion 46 which overlaps at least a portion of the rigid outer thumb shell 38, which itself in turn overlaps a proximal portion of the main thumb member 30. The outer padding portion 46 extends from an innermost cuff end of the thumb portion 12 distally outward to cover and thus protect at least a proximal end of the rigid thumb shell 38. In this embodiment, both the rigid thumb shell 38 and the outer padded portion 46 extend proximally to an inner end 48 adjacent the main cuff 18 of the protective glove. As best seen in FIG. 4, the outer padded portion 46 and the rigid thumb shell 38 remain substantially overlapped and abutted together, even while the main thumb member 30 is articulated inwardly relative thereto, such as for example when the wearer grips the stick or handlebars during use of the glove. While the outer padded portion 46 is provided in the depicted embodiment, in an alternate embodiment of the athletic glove of the present invention, the thumb portion 12 may include only a main thumb member 30 and a rigid outer thumb shell 38, thereby disposing of the necessity for the outer padding portion. In this case, either padding may be foregone on the outer surface of the rigid thumb shell or alternatively the rigid thumb shell may include padding directly in its outer surface.

In the embodiment as depicted, the rigid projection 42 is located substantially centrally between lateral edges 39 of the main thumb member 30, and near the tip 43 at the distal end 37 of the main thumb member 30. However, it is to be understood that the projection 42 may be alternately located either near one of the lateral edges 39 or may be shaped such as to extend a greater lateral distance across the dorsal outer surface of the main thumb member. Regardless, the opening 40 defined in the rigid thumb shell 38 is configured to receive at least a portion of the rigid projection 42 therein. Further, although the opening 40 is shown as an open ended notch within which at least two edges of the pentagonallyshaped rigid projection 42 are abutted, this opening 40 may alternately be an enclosed opening defined through the rigid thumb shell 38. For example, the opening may comprise a circular or polygonal-shaped enclosed hole defined through the rigid thumb shell and within which a similarly-shaped rigid projection 42 located on the main thumb member 30 in registration therewith, is received.

It is to be understood that the size and shape of both the rigid projection 42 and the corresponding opening 40 within which it is received may be modified by one skilled in the art.

The embodiments of the invention described above are intended to be exemplary. Those skilled in the art will therefore appreciate that the forgoing description is illustrative only, and that various alternatives and modifications can be devised without departing from the spirit of the present invention. Accordingly, the present is intended to embrace all such alternatives, modifications and variances which fall within the scope of the appended claims.

The invention claimed is:

1. A protective athletic glove, the glove having a thumb portion defining an inner palm side and an opposed outer side, the thumb portion comprising:

a main thumb member including a sheath within which a wearer's thumb is received and having an inner side which defines said inner palm side of the thumb portion;

a rigid outer protector disposed on said outer side of said thumb portion overtop a partial portion of said main thumb member, said main thumb member being articulated relative to said rigid outer protector such as to permit inward flexion of said main thumb member while preventing significant outward extension thereof relative to said rigid outer protector; and a rigid projection protruding from the outer side of said main thumb member, said rigid projection being received within a corresponding opening formed in said rigid outer protector when the main thumb member is fully outwardly extended relative to said rigid outer protector such that they are abutted along their length;

whereby said rigid projection, when received within said opening, limits proximal displacement of said main thumb member relative to said rigid outer protector.

2. The protective athletic glove as defined in claim 1, wherein a padded portion is disposed on said outer side of said main thumb member overtop of said sheath, said padded portion extending a full length of said main thumb member from a proximal end to a distal end thereof.

3. The protective athletic glove as defined in claim 1, wherein said rigid outer protector extends a partial distance along the said main thumb member from a proximal end towards a distal end thereof, such that said distal end is exposed.

4. The protective athletic glove as defined in claim 3, wherein said partial distance corresponds to a length of said wearer's thumb from a proximal end to an articulation between middle and distal phalanxes thereof.

5. The protective athletic glove as defined in claim 1, wherein said rigid projection protrudes from the outer side of said main thumb member near said distal end thereof.

6. The protective athletic glove as defined in claim 1, wherein said opening is formed in a distal end of said rigid outer protector.

7. The protective athletic glove as defined in claim 6, wherein said opening is a notch formed in said distal end of said rigid outer protector.

8. The protective athletic glove as defined in claim 1, wherein said rigid projection defines an upstanding button located centrally on said outer side of said main thumb member between side lateral edges thereof.

9. A protective glove for a hand, the glove including a thumb receiving portion having a dorsal side and an inner palm side, the thumb receiving portion comprising:

a rigid thumb shell covering a proximal end of the dorsal side of the thumb receiving portion such that a distal portion of the thumb receiving portion is exposed, the rigid thumb shell having a notch formed therein at a distal end thereof; and a rigid projection protruding from the dorsal side of said thumb receiving portion distally of said rigid thumb shell, said rigid projection being received within said notch of said rigid thumb shell when said thumb receiving portion is fully extended relative to said rigid thumb shell such that proximal displacement of said thumb receiving portion relative to said rigid thumb shell is limited.

10. The protective glove as defined in claim 9, wherein a padded portion is disposed on said dorsal side of said thumb receiving portion, said padded portion extending a full length of said thumb receiving portion from said proximal end to said distal end thereof.

11. The protective glove as defined in claim 9, wherein said rigid thumb shell extends a partial distance overtop of said thumb receiving portion, said partial distance corresponding to a length of said wearer's thumb from a proximal end to an articulation between middle and distal phalanxes thereof.

12. A hockey glove for protecting at least a wearer's hand having a dorsal side, a palm side, four fingers and one thumb having itself a dorsal side, an inner palm side, a middle phalanx, a distal phalanx and an articulation between said middle and distal phalanxes, the hockey glove comprising:

a rigid thumb shell disposed overtop of a dorsal side of a thumb receiving portion within which the thumb of the wearer's hand is received, the rigid thumb shell covering a proximal portion of said dorsal side of the thumb receiving portion such that a distal end thereof is dorsally exposed, the thumb receiving portion being articulated with said rigid thumb shell such that inward flexion of said thumb receiving portion away from said rigid thumb shell is permitted while significant outward extension of said thumb receiving portion relative to said rigid thumb shell is prevented; and a rigid projection protruding from the dorsal side of said thumb receiving portion distally of said rigid thumb shell, said rigid projection being received within a notch formed in a distal end of said rigid thumb shell when said thumb receiving portion is fully extended relative to said rigid thumb shell, such that proximal displacement of said thumb receiving portion relative to said rigid thumb shell is limited by said rigid projection.

13. A hockey glove for protecting at least a wearer's hand, the hockey glove including a thumb portion having a dorsal side and an inner palm side and within which a thumb of the wearer's hand is received, the thumb portion comprising:

first and second protective portions disposed on said dorsal side of the thumb portion, the second portion including a rigid shell and being disposed overtop of at least a proximal end of said first portion such that the second protective portion overlaps said first protective portion, said first and second protective portions being articulated relative to each other such that inward flexion of said first protective portion away from said second protective portion is permitted; and a rigid projection disposed on a dorsal side of said first protective portion, said rigid projection being received within an opening formed in said second protective portion when said first protective portion is aligned with and fully outwardly extended relative to said second protective portion, such that proximal displacement of said first protective portion relative to said second protective portion is limited by said rigid projection.

14. The hockey glove as defined in claim 13, wherein a distal end of said first protective portion protrudes beyond said second protective portion such that a distal end of said first protective portion is dorsally exposed.

15. The hockey glove as defined in claim 14, wherein said rigid projection is disposed on said distal end of said first protective portion.

16. The hockey glove as defined in claim 15, wherein said opening includes a notch formed in a distal end of said second protective portion within which said rigid projection is received.

17. The hockey glove as defined in claim 13, wherein said opening defines a closed perimeter and is disposed between proximal and distal ends of the second protective portion, said rigid projection being received within said opening.

18. The hockey glove as defined in claim 13, wherein said opening defines a shape corresponding to that of the rigid projection.

19. The hockey glove as defined in claim 18, wherein said rigid projection defines a pentagonal shape.

20. The hockey glove as defined in claim 18, wherein said rigid projection defines a circular shape.

* * * * *